US007409822B2

(12) United States Patent
Asanuma

(10) Patent No.: US 7,409,822 B2
(45) Date of Patent: Aug. 12, 2008

(54) EXHAUST GAS CONTROL APPARATUS AND EXHAUST GAS CONTROL METHOD FOR INTERNAL COMBUSTION ENGINE

(75) Inventor: Takamitsu Asanuma, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 270 days.

(21) Appl. No.: 10/568,351

(22) PCT Filed: Jun. 9, 2005

(86) PCT No.: PCT/IB2005/001614

§ 371 (c)(1),
(2), (4) Date: Feb. 14, 2006

(87) PCT Pub. No.: WO2005/121512

PCT Pub. Date: Dec. 22, 2005

(65) Prior Publication Data

US 2007/0065341 A1 Mar. 22, 2007

(30) Foreign Application Priority Data

Jun. 10, 2004 (JP) ..... 2004-173080

(51) Int. Cl.
*F01N 3/00* (2006.01)

(52) U.S. Cl. ..... 60/285; 600/276; 600/286

(58) Field of Classification Search ..... 6/285
See application file for complete search history.

(56) References Cited

U.S. PATENT DOCUMENTS 5,483,795 A * 1/1996 Katoh et al. ..... 60/276
6,051,123 A * 4/2000 Joshi et al. ..... 204/424
6,151,547 A * 11/2000 Kumar et al. ..... 701/101
6,484,493 B2 * 11/2002 Takanohashi ..... 60/277
6,532,733 B1 * 3/2003 Tamura et al. ..... 60/275
6,698,187 B2 * 3/2004 Nishioka et al. ..... 60/277
6,922,988 B2 * 8/2005 Yamaguchi et al. ..... 60/286
7,165,394 B2 * 1/2007 Toshioka et al. ..... 60/295
2002/0079236 A1 * 6/2002 Hurland et al. ..... 205/786.5
2003/0170577 A1 * 9/2003 Braun et al. ..... 431/3
2004/0025499 A1 2/2004 Nakatani et al.

FOREIGN PATENT DOCUMENTS

EP 0 971 101 A2 1/2000
EP 1 324 037 A1 7/2003
JP A-58-099751 6/1983

(Continued)

*Primary Examiner*—Thomas Denion
*Assistant Examiner*—Loren Edwards
(74) *Attorney, Agent, or Firm*—Oliff & Berridge, PLC

(57) ABSTRACT

An exhaust gas control apparatus for an internal combustion engine is provided with an exhaust catalyst disposed in an exhaust passage (4) of the internal combustion engine, a concentration detection unit (10) that is capable of detecting a total concentration of a sulfur oxide and a hydrogen sulfide contained in an exhaust gas that passes through the exhaust catalyst, and detecting a concentration of the sulfur oxide, and a sulfur concentration estimation unit (15) that estimates a concentration of sulfur contained in a fuel based on a detection value of the concentration detection unit (10) when it is determined that the exhaust gas is at one of a stoichiometric and rich air/fuel ratio.

8 Claims, 9 Drawing Sheets

FOREIGN PATENT DOCUMENTS

| | | |
|---|---|---|
| JP | U-02-088169 | 7/1990 |
| JP | A-06-173652 | 6/1994 |
| JP | A-2000-230419 | 8/2000 |
| JP | A-2001-303937 | 10/2001 |
| JP | A-2003-035132 | 7/2003 |

* cited by examiner

EXHAUST GAS CONTROL APPARATUS AND EXHAUST GAS CONTROL METHOD FOR INTERNAL COMBUSTION ENGINE

BACKGROUND OF THE INVENTION

1. Field of Invention

The invention relates to an exhaust gas control apparatus and an exhaust gas control method for an internal combustion engine, which is provided with a sulfur concentration sensor that detects a sulfur constituent of exhaust gas.

2. Description of Related Art

A publication of Japanese Patent Application Laid-Open No. JP-A-2001-303937 discloses an exhaust gas control apparatus for an internal combustion engine, which detects a sulfur concentration of exhaust gas by a sulfur oxides (SOx) sensor that is disposed downstream of an occlusion reduction type NOx catalyst. Publications of Japanese Patent Application Laid-Open Nos. JP-A-6-173652 and JP-A-2000-230419 further disclose related art of the invention.

The structure of the generally employed exhaust gas control apparatus as described above may fail to accurately detect the concentration of sulfur contained in the exhaust gas discharged from the internal combustion engine. When an air/fuel ratio of the exhaust gas is lean, the sulfur constituent such as SOx is oxidized, which will be held in the exhaust catalyst such as the occlusion reduction type NOx catalyst in the form of a sulfate. Meanwhile when the air/fuel ratio of the exhaust gas is rich, the sulfur constituent passes through the exhaust catalyst. Most part of the sulfur constituent that has passed through the exhaust catalyst, however, may be reduced into a hydrogen sulfide ($H_2S$) which is difficult to be detected by the SOx sensor.

SUMMARY OF THE INVENTION

It is an object of the invention to provide an exhaust gas control apparatus for an internal combustion engine, which improves an accuracy of detection of the sulfur concentration of the exhaust gas and allows an accurate estimation of the S-poisoned level of the exhaust catalyst.

An exhaust gas control apparatus for an internal combustion engine according to the invention is provided with an exhaust catalyst disposed in an exhaust passage of the internal combustion engine, a concentration detection unit that is capable of detecting a total concentration of a sulfur oxide and a hydrogen sulfide contained in an exhaust gas that passes through the exhaust catalyst, and detecting a concentration of the sulfur oxide, and a sulfur concentration estimation unit that estimates a sulfur concentration of a fuel based on a detection value of the concentration detection unit when it is determined that the exhaust gas is at one of a stoichiometric and rich air/fuel ratio.

The exhaust gas control apparatus according to the invention is capable of detecting a total concentration of the sulfur oxides and the hydrogen sulfide by the concentration detection unit. Accordingly the concentration of the sulfur constituent of the exhaust gas can be accurately detected. As the sulfur concentration of the fuel is estimated based on the total concentration, the amount of sulfur adhered to the exhaust catalyst may be accurately estimated.

In the above-structured exhaust gas control apparatus, an air/fuel ratio control unit that controls the air/fuel ratio of the exhaust gas into one of the stoichiometric state and the rich state may be provided. In this case, the air/fuel ratio of the exhaust gas is changed by the air/fuel ratio control unit so as to estimate the sulfur concentration of the fuel at an arbitrary timing.

In the exhaust gas control apparatus as described above, the air/fuel ratio control unit executes a rich spike control in which the air/fuel ratio of the exhaust gas is temporarily brought into the rich state at a predetermined cycle. The air/fuel ratio control unit may be provided with a rich amount increase unit that executes at least one of a control for holding the air/fuel ratio of the exhaust gas in the rich state for a longer time than a time under the rich spike control, and a control for bringing the air/fuel ratio of the exhaust gas into a richer state than a state under the rich spike control. The control of the air/fuel ratio of the exhaust gas upon estimation of the sulfur concentration allows the concentration detection unit to accurately detect the sulfur concentration of the exhaust gas discharged from the internal combustion engine. Under the control for holding the rich state for a longer time than that taken under the rich spike control, the air/fuel ratio of the exhaust gas downstream of the exhaust catalyst may be brought into the rich state while restraining the change in the operation state of the engine. Under the control for bringing the air/fuel ratio of the exhaust gas into richer state than the state under the rich spike control, the amount of the sulfur content passing toward the downstream of the exhaust catalyst may be increased.

In the exhaust gas control apparatus, as the exhaust catalyst, a NOx catalyst of occlusion and reduction type is employed. A NOx occluded amount estimation unit is provided for estimating an amount of NOx that has been occluded in the NOx catalyst. The air/fuel ratio control unit may be structured to control the air/fuel ratio of the exhaust gas into one of the stoichiometric state and the rich state when the NOx occluded amount estimated by the NOx occluded amount estimation unit is determined to be equal to or larger than a predetermined amount. In the case where the NOx catalyst is provided as the exhaust catalyst, when the amount of occluded NOx becomes equal to or larger than a predetermined value, the air/fuel ratio of the exhaust gas is set to the stoichiometric or rich state such that the NOx occluded in the NOx catalyst is released, that is, NOx reduction is performed. This makes it possible to estimate the sulfur concentration of the fuel upon NOx reduction.

The exhaust gas control apparatus for the internal combustion engine may be provided with a catalytic temperature detection unit that detects a temperature of the exhaust catalyst. The sulfur concentration estimation unit may inhibit an estimation of the concentration of sulfur contained in the fuel when it is determined that the temperature detected by the catalytic temperature detection unit is equal to or higher than a predetermined temperature. When the temperature of the exhaust catalyst increases, the sulfur constituent that has been held in the catalyst may be released. Then the concentration detection unit detects both the sulfur constituent in the exhaust gas and the sulfur constituent that has been released from the catalyst. The resultant sulfur concentration, thus, is a false value. In this case, the estimation of the sulfur concentration is inhibited.

The term "inhibition of estimation" used herein may include not only the case where the estimation of the sulfur concentration is inhibited but also the case where the estimation of the sulfur concentration is allowed, and the use of the estimated sulfur concentration is inhibited.

In an exhaust gas control method for an internal combustion engine, in which an exhaust catalyst is disposed in an exhaust passage of the internal combustion engine, and a concentration detection unit that is capable of detecting a total concentration of a sulfur oxide and a hydrogen sulfide contained in an exhaust gas that passes through the exhaust catalyst, and detecting a concentration of the sulfur oxide, a sulfur concentration of a fuel is estimated based on a detection value of the concentration detection unit when it is determined that the exhaust gas is at one of a stoichiometric and rich air/fuel ratio.

According to the invention, the concentration detection unit makes it possible to accurately detect the sulfur concentration of the exhaust gas. Accordingly the accuracy of estimation of the sulfur concentration of the fuel can further be improved. This may allow the accuracy in estimation of the timing for recovering the exhaust catalyst that has been degraded or S-poisoned by accurately estimating the S-poisoned level of the exhaust catalyst.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIG. 3 shows the detecting function of the sulfur concentration sensor as shown in FIG. 2, and more particularly.

DETAILED DESCRIPTION OF PREFERRED EMBODIMENTS

Figure 1:
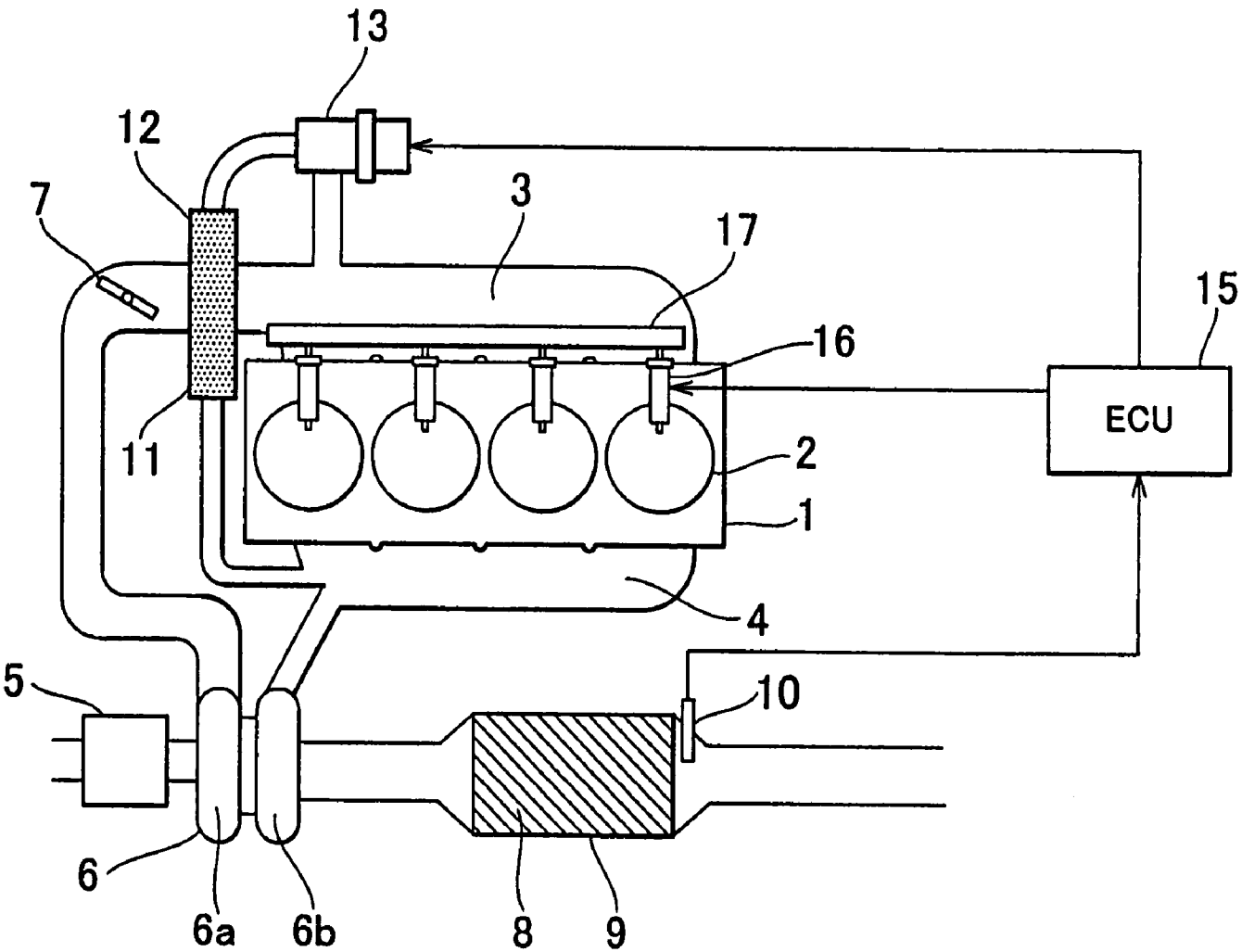
FIG. 1 is a schematic view that represents an embodiment of an internal combustion engine to which the invention is applied.

FIG. 1 shows an embodiment of the invention applied to a diesel engine 1 as an internal combustion engine. The engine 1 is mounted in a vehicle as a power source for running and has a cylinder 2 connected to an intake passage 3 and an exhaust passage 4. The intake passage 3 is provided with an air filter 5 for filtrating intake air, a compressor 6*a* of a turbo charger 6, and a throttle valve 7 for adjusting the intake air amount. The exhaust passage 4 is provided with a turbine 6*b* of the turbo charger 6. An exhaust gas control unit 9 that contains an occlusion and reduction type NOx catalyst (hereinafter referred to as a catalyst) 8, and a sulfur concentration sensor 10 as a concentration detection unit that detects the concentration of sulfur contained in the exhaust gas downstream of the catalyst 8. The exhaust gas control unit 9 may be formed by carrying a NOx catalytic substance to a diesel particulate filter which traps particulate matters contained in the exhaust gas, or provided separately from such filter. The exhaust passage 4 is connected to the intake passage 3 through an EGR passage 11 in which an EGR cooler 12 and an EGR valve 13 are provided.

The air/fuel ratio of exhaust gas at a position at which the NOx catalyst 8 is provided, which may be called as an exhaust air/fuel ratio, and a temperature of the NOx catalyst 8 are controlled by an engine control unit (ECU) 15. The ECU 15 is a known computer unit that controls an operation state of the engine by operating a fuel injection valve 16 for injecting the fuel into the cylinder 2, a pressure regulating valve of a common rail 17 at which the fuel pressure supplied to the fuel injection valve 16 is stored, or various devices such as a throttle valve 7 and an EGR valve 13 as described above. The ECU 15 controls a fuel injecting operation of the fuel injection valve 16 such that the air/fuel ratio set as a mass ratio of air admitted into the cylinder 2 to the fuel added from the fuel injection valve 16 is controlled into a predetermined target air/fuel ratio. In a normal operation state, the target air/fuel ratio is controlled into a lean state where the amount of air is larger than that of air at a stoichiometric air/fuel ratio. If it is determined that the amount of NOx occluded in the NOx catalyst 8 is equal to or larger than a predetermined amount, an operation of the fuel injection valve 16 is controlled such that the exhaust air/fuel ratio is temporarily brought into the rich state (rich spike) at a predetermined cycle in order to reduce the NOx that has been occluded in the NOx catalyst 8. The ECU controls the exhaust air/fuel ratio as an air/fuel ratio control unit. The ECU 15 is structured to control other devices (not shown). The engine 1 is provided with various sensors such as an exhaust gas temperature sensor and an air/fuel sensor (not shown) as the detection unit for executing the aforementioned various control routines.

Figure 2:
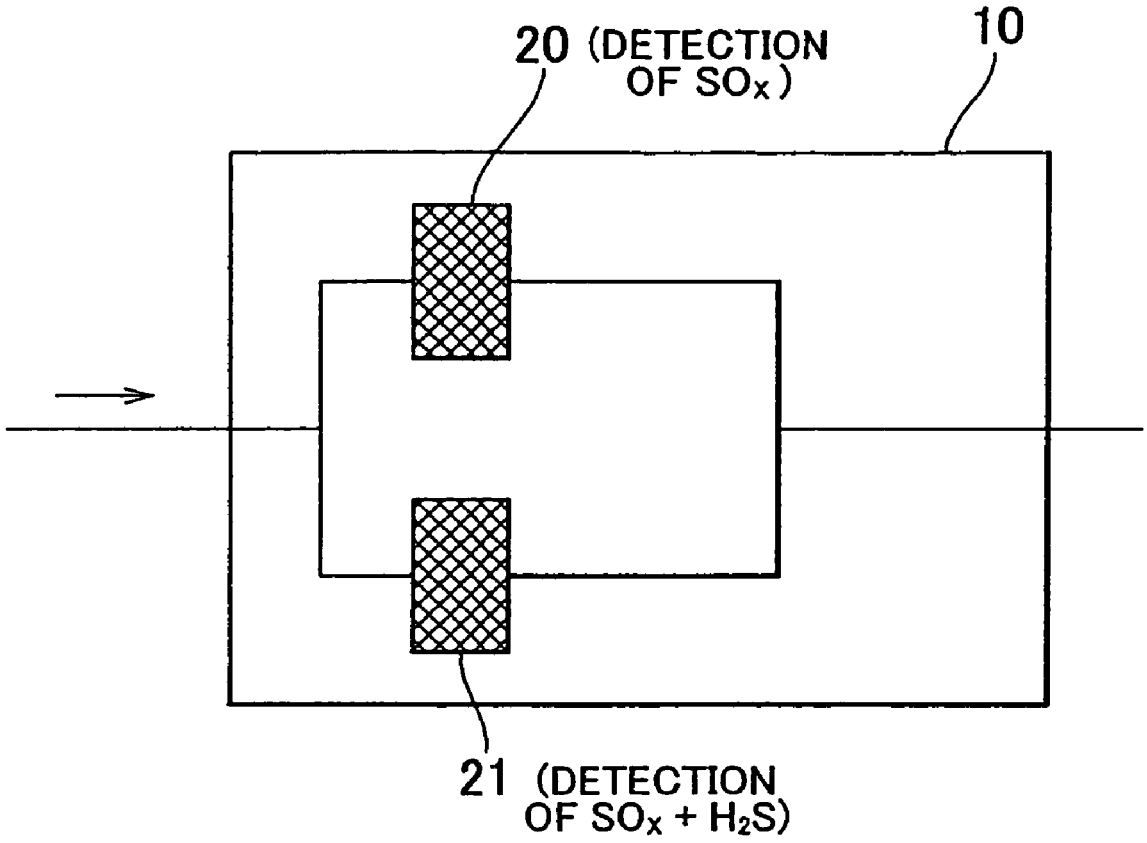
FIG. 2 is a view that schematically shows a structure of a sulfur concentration sensor used in an exhaust catalyst as shown in FIG. 1.
Figure 3A:
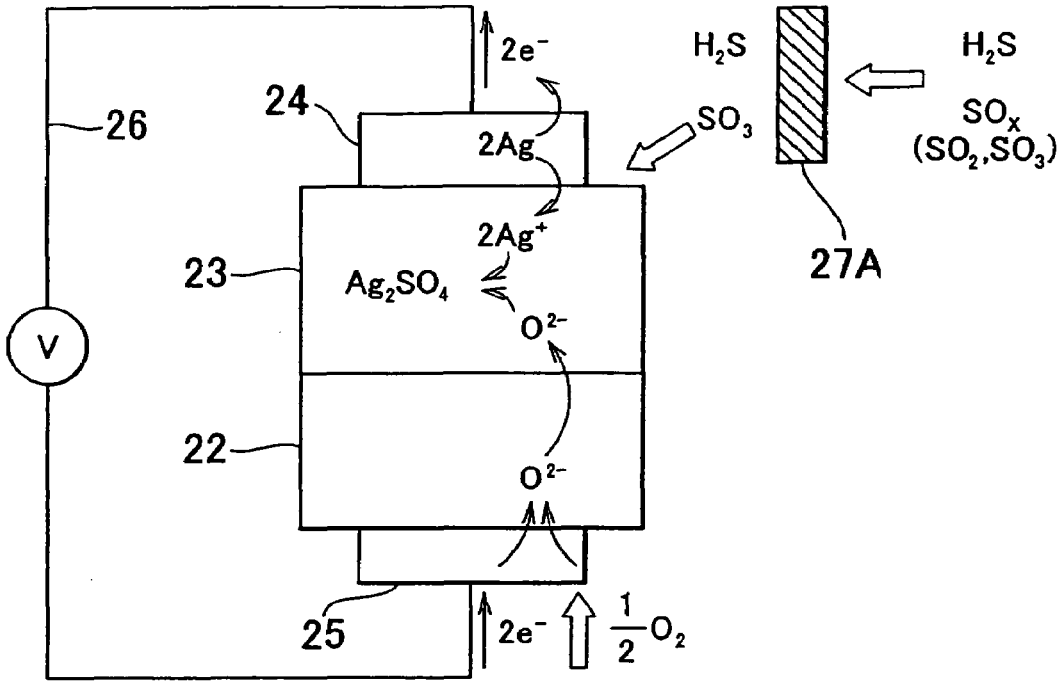
FIG. 3A shows the detecting function of a SOx concentration detection unit.
Figure 3B:
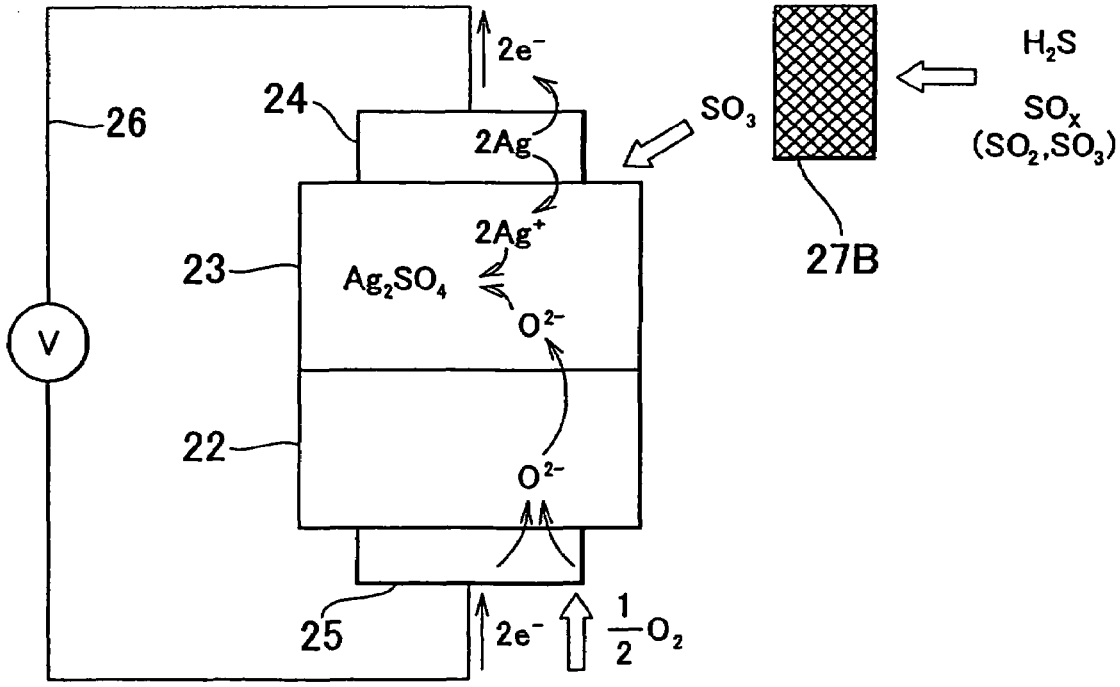
FIG. 3B shows the detecting function of a total concentration detection unit, respectively.

An example of the sulfur concentration sensor 10 will be described referring to FIGS. 2 and 3. As shown in FIG. 2, the sulfur concentration sensor 10 includes a SOx concentration detection unit 20 that detects a SOx concentration of the exhaust gas, and a total concentration detection unit 21 that detects a sum of the SOx concentration and $H_2S$ concentration of the exhaust gas. FIG. 3A shows how the SOx concentration detection unit 20 detects the SOx concentration, and FIG. 3B shows how the total concentration detection unit 21 detects the total concentration, respectively. As shown in FIG. 3A, the SOx concentration detection unit 20 includes a sub-electrode 23 and a detection electrode 24 on one surface of an oxygen ion conductor 22, and a reference electrode 25 on the other surface of the oxygen ion conductor 22. For example, yttria stabilized zirconia is used as the oxygen ion conductor 22, sulfate is used as the sub-electrode 23, silver (Ag) is used as the detection electrode 24, and platinum (Pt) is used as the reference electrode 25, respectively. The sulfate is preferably formed of a mixed salt of silver sulfate ($Ag_2SO_4$) and Barium sulfate ($BaSO_4$). The silver sulfate involves a responsive reaction of the sub-electrode 23, to which the barium sulfate is added for stabilization. Metallic silver involves a responsive reaction of the detection electrode 24. Preferably a silver-plated platinum is employed for improving the strength of the electrode.

The detection performed by the SOx concentration detection unit 20 will be described. Most part of sulfur oxides (SOx, mostly sulfur dioxide $SO_2$) introduced into the SOx concentration detection unit 20 is oxidized by an oxidation catalyst 27A into sulfur trioxide ($SO_3$). The sulfur trioxide $SO_3$ reacts with the metallic silver of the detection electrode 24, which causes electrons to be released from the metallic silver. The residual silver ion (Ag+) moves to the sub-electrode 23. The electrons released from the detection electrode 24 are introduced into the reference electrode 25 via an outside circuit 26. At the reference electrode 25, the electron is combined with oxygen ($O_2$), and oxygen ions ($O^{2-}$) are generated. The oxygen ion passes through the oxygen ion conductor 22 to move toward the sub-electrode 23. The silver ion and the oxygen ion are reacted with the $SO_3$ on the sub-electrode 23 into the silver sulfate. The aforementioned reactions generate an electromotive force between the detection electrode 24 and the reference electrode 25 under the condition where an oxygen partial pressure is constant. The SOx concentration is detected by measuring the electromotive force. The $H_2S$ that has passed through the oxidation catalyst with a weak oxidizing capability is hardly oxidized. As a result, the electromotive force in the SOx concentration detection unit 20 does not reflect the $H_2S$ concentration.

As FIG. 3B shows, the total concentration detection unit 21 includes an oxidation catalyst 27B with higher oxidizing capability exhibiting oxidation catalytic activity with respect to $H_2S$ instead of the catalyst 27A with lower oxidizing capability. Other structure is the same as that of the SOx concentration detection unit 20 except that the total concentration detection unit 21 serves to cause $SO_2$ and $H_2S$ to be formed into $SO_3$ through the oxidation catalyst 27B, and the produced $SO_3$ and $SO_3$ contained in the exhaust gas are reacted with silver ion on the sub-electrode 23 and silver metal on the detection electrode 24 so as to generate the electromotive force corresponding to the total concentration of the concentrations of SOx and $H_2S$ of the exhaust gas. The sulfur concentration sensor 10 detects the difference between the electromotive forces detected in the detection units 20 and 21 so as to detect the concentration of the $H_2S$ of the exhaust gas. The difference in the oxidation capabilities between the oxidation catalysts 27A and 27B is realized by making each density of platinum as the catalyst, each capacity of the catalysts 27A and 27B different, or using different materials for forming the catalysts 27A and 27B. More specifically, the density of Pt of the catalyst 27A exhibiting lower oxidizing capability is made small, that is, the amount of carried Pt is made smaller. The density of Pt of the catalyst 27B exhibiting higher oxidizing capability is made large, that is, the amount of carried Pt is made larger. Alternatively, the capacity of the catalyst 27A may be made small and the capacity of the catalyst 27B may be made large while keeping the density of Pt of each of the catalysts 27A and 27B equal. The catalytic material that exhibits low oxidizing capability may be employed as the catalyst 27A (for example, palladium Pd), and the catalytic material that exhibits high oxidizing capability may be employed as the catalyst 27B (for example, platinum Pt). Execution of the control under which the temperature of the catalyst 27A that exhibits low oxidizing capability is made lower than the temperature of the catalyst 27B that exhibits high oxidizing capability makes it possible to differentiate the oxidizing capability of the catalyst 27A from that of the catalyst 27B. The differentiation may be made with respect to the oxidizing capability of the catalysts 27A and 27B by combining the aforementioned processes. In the sulfur concentration sensor 10, oxygen is used for detecting both the SOx concentration and the total concentration. Accordingly air (new air) that contains oxygen sufficient to have reaction may be supplied to the detection units 20, 21 so as to reliably detect those concentrations even under the S-poisoning recovery process for controlling the exhaust air/fuel ratio into the rich state. The electrode that exhibits the oxidation catalyst activity with respect to $H_2S$ may be employed as the oxidation catalyst 27B. The sulfur concentration sensor 10 may be provided with a temperature control unit such as a heater for maintaining its temperature in a predetermined reaction range.

Figure 4:
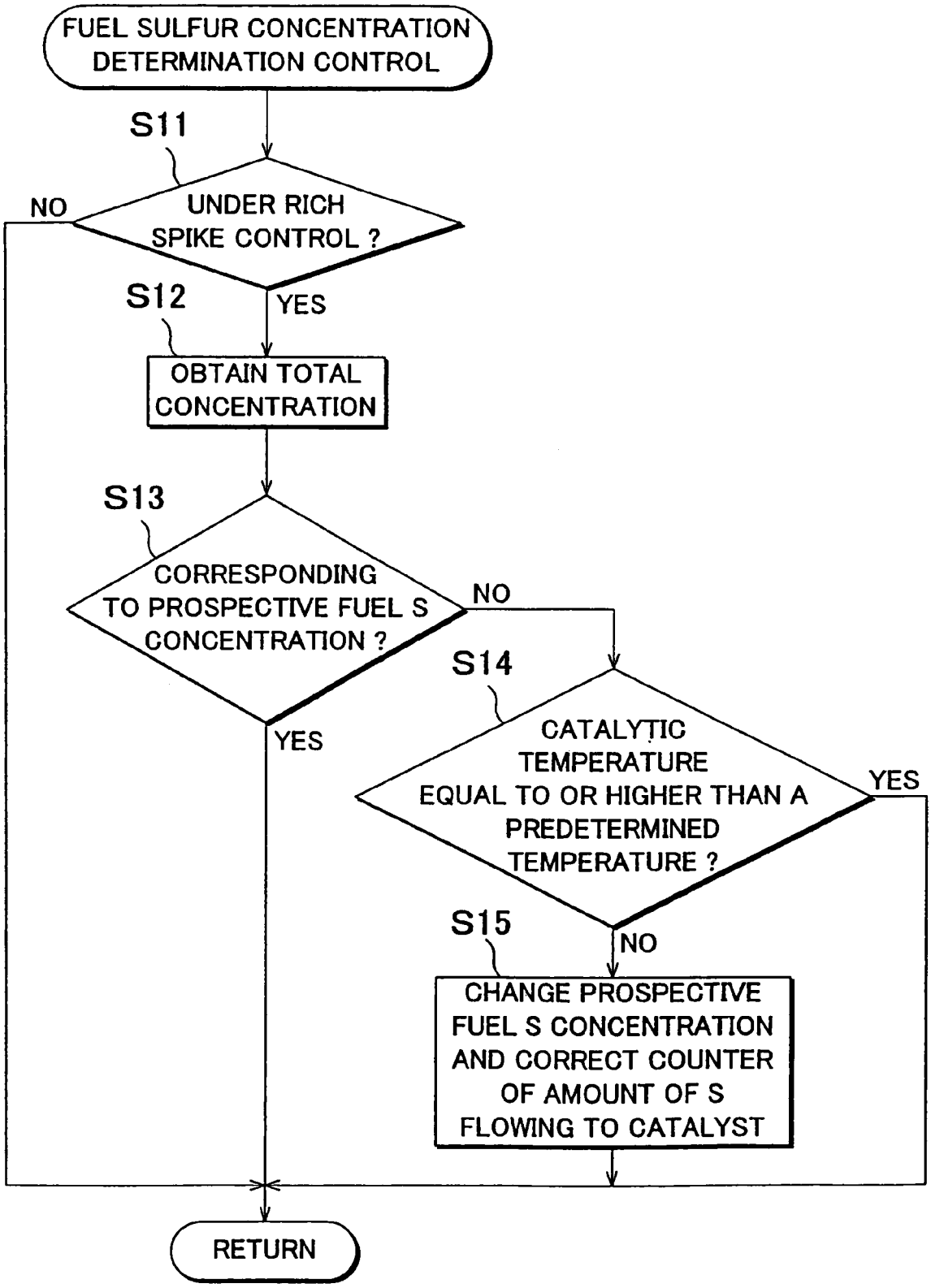
FIG. 4 is a flowchart that shows a control routine executed by an ECU shown in FIG. 1 for determining sulfur concentration of fuel.

As the NOx catalyst 8 is poisoned by the sulfur constituent contained in the exhaust gas (S-poisoned), its exhaust gas control capability is gradually deteriorated. The ECU 15 executes the S-recovery process for recovering the gas control capability by releasing the sulfur constituent from the catalyst 8 when it is determined that the total value of the amount of the sulfur content (S amount) entered into the catalyst 8 becomes equal to or predetermined amount that may deteriorate the purifying performance of the catalyst 8, the sulfur content is released from the catalyst 8 so as to recover the purifying capability, that is, S-recovery process. The S amount flowing into the catalyst 8 is calculated based on the amount of the fuel supplied to the engine 1, and the S concentration (prospective concentration) that is assumed to be contained in the fuel. The error between the prospective S concentration and the actual S concentration of the fuel supplied to the engine 1 is relatively large, the estimation accuracy of S-poisoned level of the catalyst 8 is lowered, and the S-recovery process cannot be appropriately performed. The ECU 15 executes the control routine for determining the sulfur concentration of the fuel as shown by a flowchart of FIG. 4 such that the concentration of sulfur contained in the fuel is obtained. The control routine shown in FIG. 4 is repeatedly executed at a predetermined cycle during the operation of the engine 1. In this case, the ECU 15 executes the control routine shown in FIG. 4 as the sulfur concentration estimation unit.

Figures 5A, 5B, 5C:
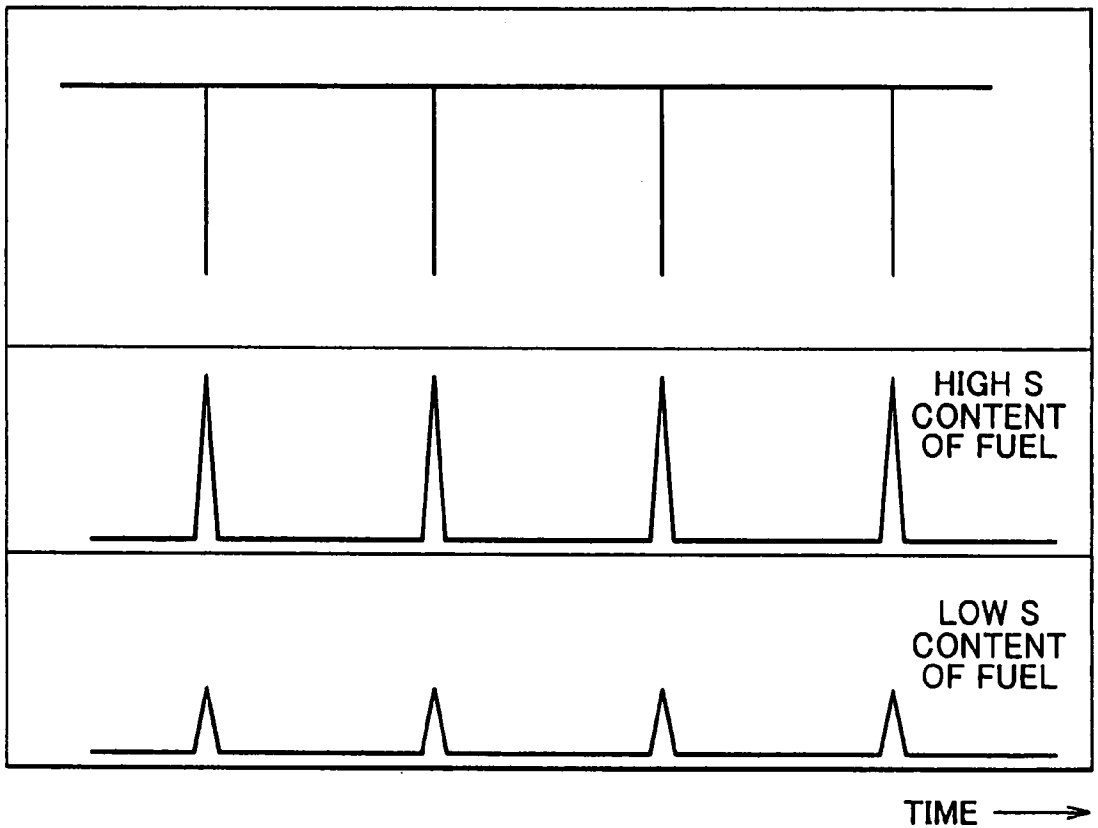
FIG. 5 shows an example of a change in the total concentration as time elapses under the rich spike control.

Referring to the flowchart of the control routine as shown in FIG. 4, first in step S11, it is determined whether the engine 1 is under the rich spike control. The ECU 15 estimates the amount of NOx that enters into the NOx catalyst 8 based on each amount of the fuel and intake air supplied to the engine 1 in another routine. Then the estimated NOx amount is summed up such that the amount of NOx that has been occluded in the NOx catalyst 8 is estimated. The ECU 15 estimates the amount of the occluded NOx in the NOx catalyst 8 as the NOx occluded amount estimation unit. The rich spike control is executed when it is determined that the total value of the NOx occluded amount is equal to or larger than a predetermined value. The predetermined value may be set to the amount of NOx detected when the exhaust gas control capability deteriorates. If it is determined that the rich spike control is not executed, the control routine ends. Meanwhile, if it is determined that the rich spike control is executed, the process proceeds to step S12 where the ECU 15 obtains the total concentration of SOx and $H_2S$ of the exhaust gas. If the detection values of the total concentration widely vary, the detection may be performed a plurality of times until the detection values are stabilized. FIG. 5 shows an example of the change in the total concentration under the rich spike control as time elapses. FIG. 5A shows the change in the exhaust air/fuel ratio as time elapses, and FIG. 5B shows the change in the total concentration as time elapses at high sulfur concentration of the fuel. FIG. 5C further shows the change in the total concentration as time elapses at low sulfur concentration of the fuel. As has been clearly shown in FIGS. 5B and 5C, if the exhaust air/fuel ratio is changed to be in the rich state, the total concentration of the exhaust gas is detected.

In step S13, the ECU 15 estimates the concentration of sulfur contained in the fuel based on the obtained total concentration. It is then determined whether the estimated sulfur concentration of the fuel is about the same as the prospective S concentration of the fuel. As the fuel (diesel oil) supplied into an empty fuel tank (not shown) of the engine 1 is produced such that its sulfur concentration becomes within a predetermined range, such sulfur concentration may be set as the initial value of the prospective S concentration of the fuel. The value of the obtained total concentration may vary depending on the air/fuel ratio before execution of the rich spike control, or the amount of oxygen that has been occluded in the catalyst 8. In step S13, if the total concentration is in a tolerance range between the upper limit value and the lower limit value with respect to the center value of the total concentration derived from the prospective S concentration of the fuel, it may be determined that the estimated fuel sulfur concentration is about the same as the prospective S concentration of the fuel.

If it is determined that the estimated fuel sulfur concentration is about the same as prospective S concentration of the fuel, the control routine ends. Meanwhile, if it is determined that the estimated fuel sulfur concentration is not about the same as the prospective S concentration of the fuel, the process proceeds to step S14 where the ECU 15 determines whether the temperature of the NOx catalyst 8 is equal to or higher than a predetermined temperature. The temperature of the NOx catalyst 8 may be estimated by the ECU 15 based on the operation state of the engine 1, or detected by a temperature sensor. In the aforementioned case, the ECU 15 estimates the temperature of the NOx catalyst 8 based on the operation state of the engine as the catalytic temperature detection unit. The temperature at which the sulfur constituent that has been occluded in the catalyst 8 starts desorbing is set as the predetermined temperature. If it is determined that the catalytic temperature is equal to or higher than the predetermined temperature, the control routine ends. Meanwhile, if it is determined that the catalytic temperature is not equal to or higher than the predetermined temperature, the process proceeds to step S15 where the ECU 15 changes the prospective S concentration of the fuel. In this case, the estimated fuel sulfur concentration that has been estimated in step S13, for example, is substituted for the prospective S concentration of the fuel. The ECU 15 counts the total value of the S amount flowing into the catalyst 8 in the other routine to estimate the S-poisoned level of the catalyst 8 for the purpose of determining the timing for executing the aforementioned S-recovery process. For example, the counter value of the S amount flowing into the NOx catalyst 8 is corrected based on, for example, the estimated fuel sulfur concentration, the difference between the estimated fuel sulfur concentration and the prospective S concentration of the fuel and the like. Then the control routine ends.

Figure 6:
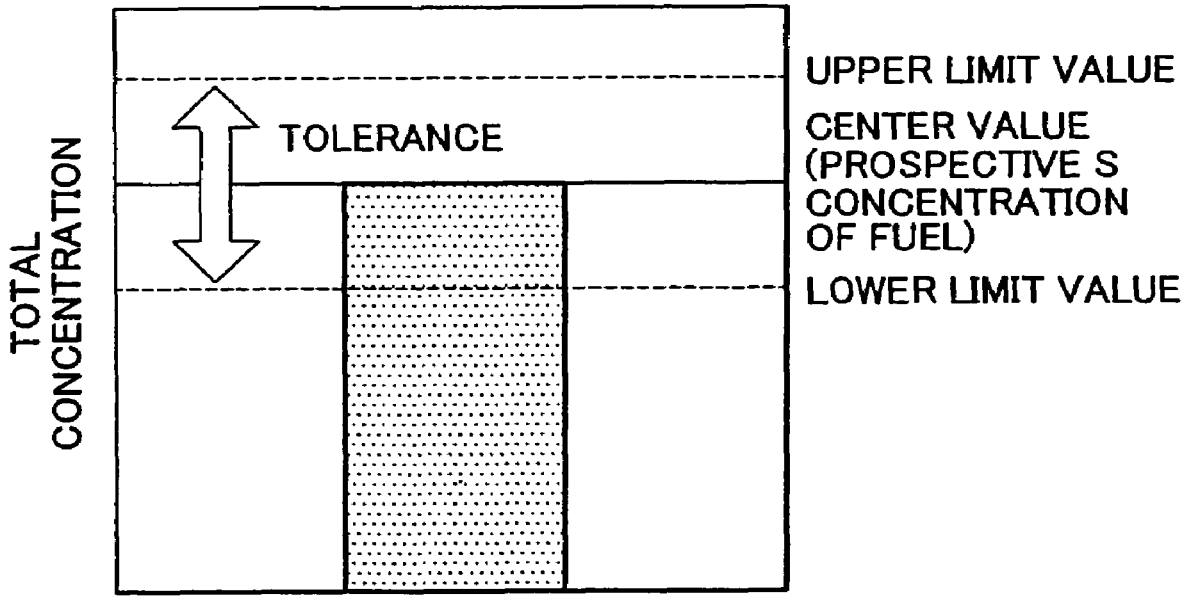
FIG. 6 shows a criterion based on which the determination of an estimated sulfur concentration of the fuel is made.

Execution of the control routine shown in FIG. 4 makes it possible to accurately estimate the concentration of the sulfur contained in the fuel based on the total concentration. Accordingly the S-poisoned level of the NOx catalyst 8 can further be accurately obtained. The NOx catalyst 8 is subjected to the S-recovery process for preventing deterioration in the exhaust emission. The prospective S concentration of the fuel does not have to be changed immediately if it is determined that the estimated fuel sulfur concentration is not about the same as the prospective S concentration of the fuel. For example, if it is determined that the average fuel sulfur concentration of those obtained through a plurality of estimations is different from the prospective S concentration of the fuel, the prospective S concentration of the fuel may be changed. A reference value based on which the prospective S concentration of the fuel is changed may be provided separately from the tolerance range as shown in FIG. 6. If it is determined that the estimated fuel sulfur concentration deviates from the prospective S concentration of the fuel by the amount equal to or larger than the reference value, the prospective S concentration of the fuel may be changed. The change in the prospective S concentration of the fuel is determined based on the process as aforementioned so as to prevent false change in the prospective fuel as well as improve the estimation accuracy of the S-poisoned level.

The other example of the control routine for allowing the ECU 15 to serve as the sulfur concentration estimation unit will be described referring to FIG. 7. The routine is repeatedly executed at a predetermined cycle during the operation of the engine 1. The same process as that of the control routine in FIG. 4 will be designated with the same reference numerals, and its description, thus, will be omitted.

Figure 7:
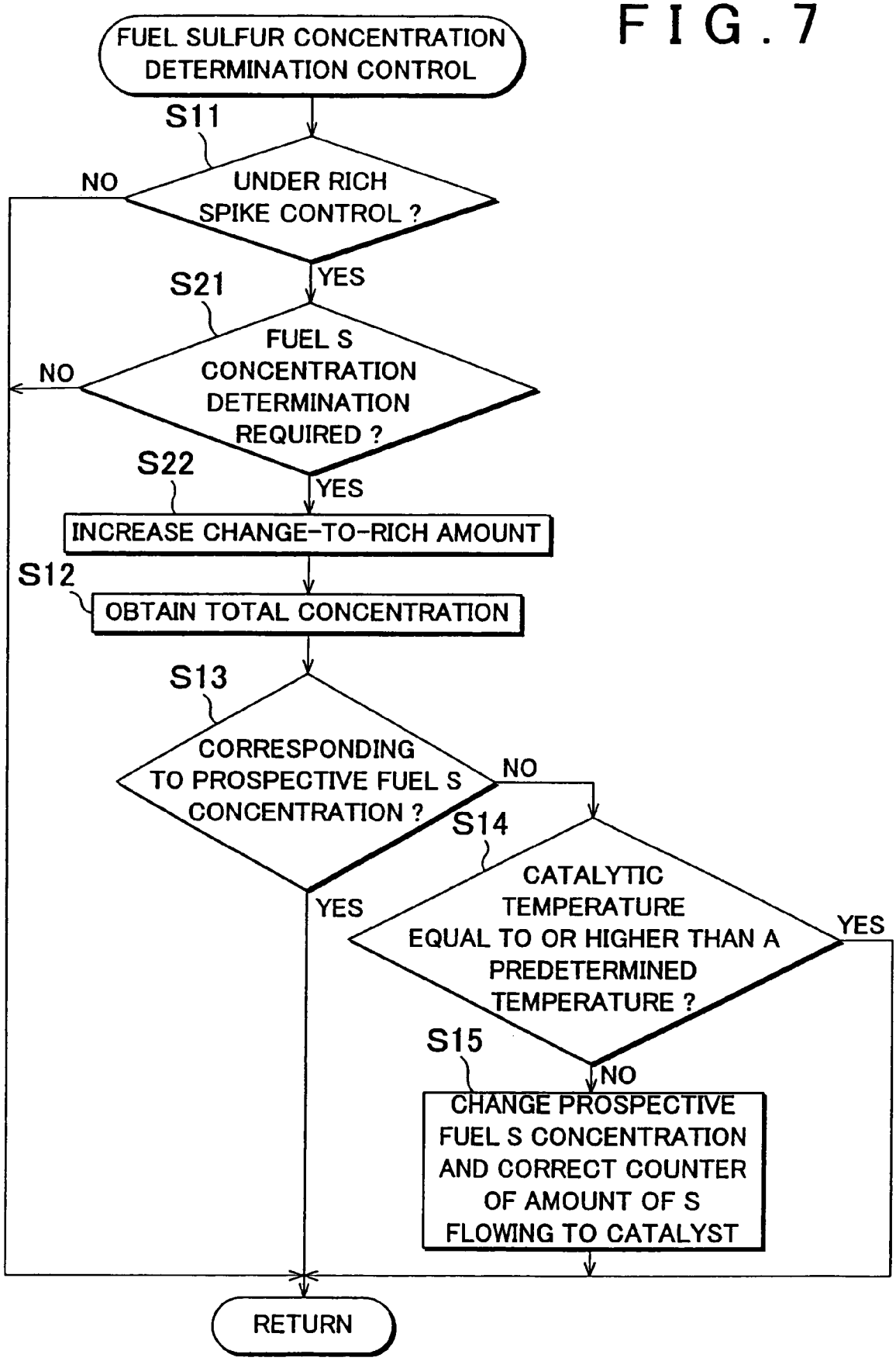
FIG. 7 is a flowchart that shows another embodiment of the control routine executed by the ECU shown in FIG. 1 for determining the sulfur concentration of the fuel.

Referring to the flowchart of the control routine shown in FIG. 7, the ECU 15 determines in step S11 whether the rich spike control is being executed. If it is determined that the rich spike control is executed, the process proceeds to step S21 and subsequent steps. Meanwhile if it is determined that the rich spike is not executed, the control routine ends. The ECU 15 determines whether the request for determining the sulfur concentration of the fuel has been received. The request for determination may be made based on the running distance of the vehicle on which the engine 1 is mounted, or the fuel amount consumed by the engine 1. The request is issued every time when those values are counted by a predetermined amount so as to estimate the sulfur concentration of the fuel at a constant cycle. If the fuel is supplied into the fuel tank (not shown), the sulfur concentration in the fuel changes, and accordingly the request for determination may be made. If it is determined that there has been no request for determination, the control routine ends. Meanwhile if it is determined that the request for determination has been issued, the process proceeds to step S22 where the ECU 15 increases a change-to-rich amount that brings the exhaust air fuel ratio into the rich state. Subsequently in step S12 and onward, the same process as that in the control routine shown in FIG. 4 is executed. The control routine, then, ends.

Figure 8A:
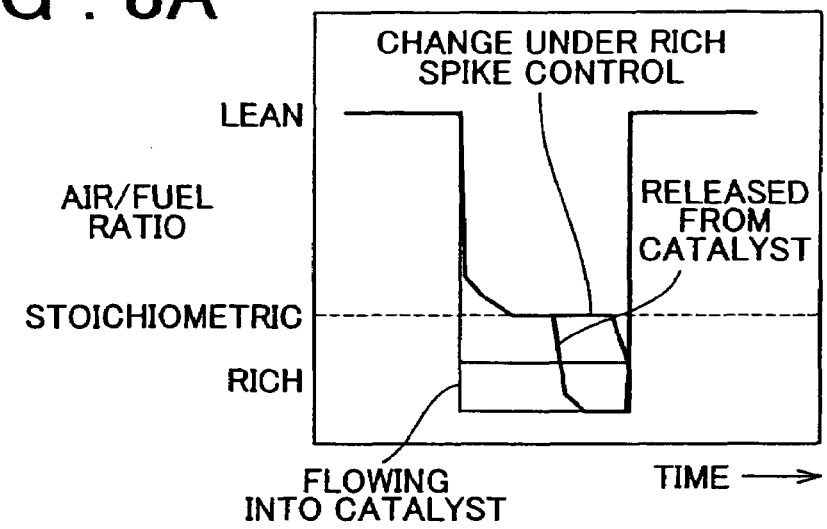
FIGS. 8A to 8C show examples of the respective changes in the air/fuel ratios of the exhaust gas upstream and downstream of the NOx catalyst as time elapses when a change-to-rich amount is increased.
Figure 8B:
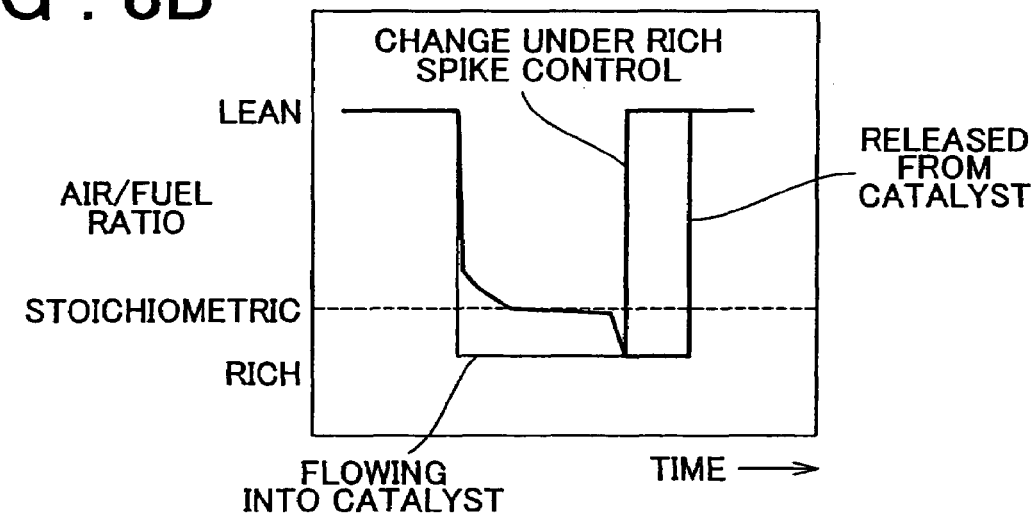
Figure 8C:
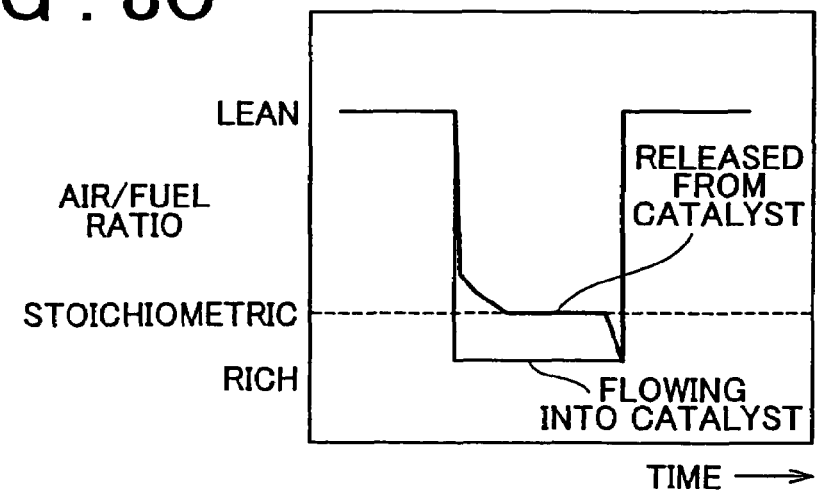

The increase in the change-to-rich amount will be described hereinafter. The time taken for the exhaust air/fuel ratio downstream of the NOx catalyst 8 to be brought into the rich state may be short upon change in the exhaust air/fuel ratio under the rich spike control depending on the amount of oxygen occluded in the NOx catalyst 8. When the sulfur concentration of the fuel is estimated, the change-to-rich amount of the air/fuel ratio is increased to be larger than the case under the rich spike control so as to make sure that the exhaust air/fuel ratio downstream of the NOx catalyst 8 is brought into the rich state, and the total concentration is detected. FIGS. 8A to 8C respectively show each example of the change in the exhaust air/fuel ratio as an elapse of time upstream and downstream of the NOx catalyst 8 in the case where the change-to-rich amount is increased. More specifically FIG. 8A shows an example of the change in the exhaust air/fuel ratio as the elapse of time upstream and downstream of the NOx catalyst 8 when the exhaust air/fuel ratio is changed to the richer state than in the case under the rich spike control. FIG. 8B shows an example of the change in the exhaust air/fuel ratio as the elapse of time upstream and downstream of the NOx catalyst 8 when the exhaust air/fuel ratio is held in the rich state for a longer time than the case under the rich spike control. FIG. 8C shows a comparative example of the change in the exhaust air/fuel ratio as the elapse of time upstream and downstream of the NOx catalyst 8 under the rich spike control. The increase in the change-to-rich amount may be made by increasing the change amount in the air/fuel ratio to be brought into the rich state as shown in FIG. 8A, or by increasing the time taken for holding the exhaust air/fuel ratio in the rich state to be longer as shown in FIG. 8B. Alternatively the processes as shown in FIGS. 8A and 8B may be combined. When the exhaust air/fuel ratio upstream of the NOx catalyst 8 is changed to be in a richer state than in the case under the rich spike control as shown in FIG. 8A, the time for bringing the exhaust air/fuel ratio downstream of the NOx catalyst 8 into the rich state may be increased even if the time for holding the exhaust air/fuel ratio in the rich state is kept constant. As the change-to-rich amount is increased, the sulfur concentration sensor 10 may serve to detect the total concentration. When the time for holding the exhaust air/fuel ratio in the rich state is increased as shown in FIG. 8B, the time for bringing the exhaust air/fuel ratio downstream of the NOx catalyst 8 into the rich state may be obtained while restraining the change in the exhaust air/fuel ratio into the rich state. As the time for holding the exhaust air/fuel ratio in the rich state is increased, the exhaust air/fuel ratio downstream of the NOx catalyst 8 may be brought into the rich state while restraining the change in the operation of the engine 1. The ECU 15 increases the change-to-rich amount in the exhaust air/fuel ratio as a rich amount increase unit.

Figures 9A, 9B:
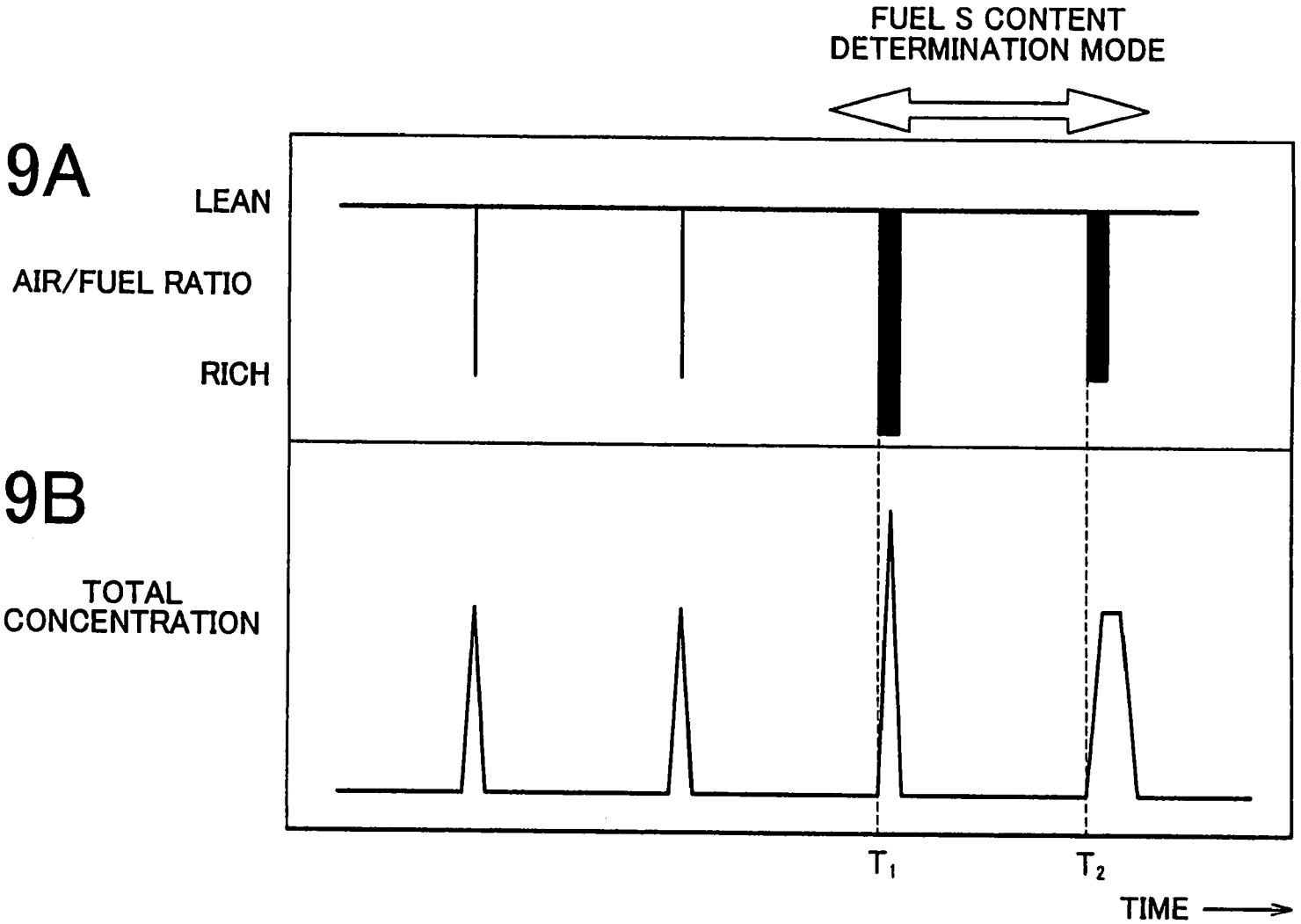
FIG. 9 shows an example of the change in the total concentration as time elapses when the change-to-rich amount is increased.

FIG. 9 shows an example of a change in the total concentration as the elapse of time when the change-to-rich amount is increased. FIG. 9A shows an example of the change in the exhaust air/fuel ratio as the elapse of time, and FIG. 9B shows an example of the change in the total concentration as the elapse of time, respectively. Referring to FIG. 9, at a time T1, the amount of change in the exhaust air/fuel ratio into the rich state is increased (FIG. 8A), and at a time T2, the time for holding the exhaust air/fuel ratio in the rich state is increased (FIG. 8B) so as to increase the change-to-rich amount. As it is clear from FIG. 9, the amount of change in the exhaust air/fuel ratio into the rich state is increased to increase the sulfur constituent of the exhaust gas passing downstream of the NOx catalyst 8, thus increasing the detection value of the total concentration. This makes it possible to accurately estimate the sulfur concentration of the fuel. The time for holding the exhaust air/fuel ratio in the rich state is increased so as to increase the time for detecting the total concentration, which makes sure to accurately detect the total concentration.

The change-to-rich amount is increased when the sulfur concentration of the fuel is estimated. This makes it possible to improve the accuracy in detection of the total concentration. Accordingly, the sulfur concentration of the fuel may further be accurately estimated.

The invention is not limited to the aforementioned embodiments but may be implemented in various forms. For example, the invention may be applied not only to the diesel engine but also various types of internal combustion engine in which gasoline or other fuel is used. The exhaust catalyst provided in the exhaust passage is not limited to the occlusion reduction type NOx catalyst. The invention may be applied to the internal combustion engine provided with other type of exhaust catalyst such as the three-way catalyst. For example, in the case where the exhaust air/fuel ratio is in the lean state, the sulfur constituent of the exhaust gas discharged from the engine is oxidized by the sulfate and adhered to the three-way catalyst. Accordingly the sulfur concentration of the fuel can be accurately estimated in the aforementioned case.

The timing at which the routine for estimating the sulfur concentration of the fuel is not limited to that under the rich spike control. For example, the sulfur concentration may be estimated at a timing when the engine is operated at a high load. At the aforementioned timing, the opening degree of the throttle valve is set to be larger such that the exhaust air/fuel ratio is held in the rich state for an elongated time. Accordingly the total concentration may be accurately detected.

In the aforementioned embodiment, the sulfur concentration sensor is structured to have a SOx concentration detection section that detects the SOx concentration and a total concentration detection section that detects the total concentration simultaneously. The sulfur concentration sensor may be structured such that the aforementioned operations for detecting the concentration is alternately performed at an appropriate cycle.

According to the invention, the occlusion reduction type NOx catalyst is expected to hold the NOx therein in an arbitrary mechanism, for example, absorption, adsorption or whatsoever. The poisoning of SOx, and release of the NOx or SOx are not particularly specified herein. The control of the engine operation state in the invention is not limited to the control that relates to the combustion control in the cylinder. The control to be executed in the portion other than the cylinder, for example, addition of the fuel or air in the exhaust passage may be regarded as being within the scope of the invention.

The invention claimed is:

1. An exhaust gas control apparatus for an internal combustion engine, comprising:

an exhaust catalyst disposed in an exhaust passage of the internal combustion engine;

a concentration detection unit that is capable of detecting a total concentration of a sulfur oxide and a hydrogen sulfide contained in an exhaust gas that passes through the exhaust catalyst, and detecting a concentration of the sulfur oxide;

a catalytic temperature detection unit that detects a temperature of the exhaust catalyst; and a sulfur concentration estimation unit that estimates a sulfur concentration of a fuel based on a detection value of the concentration detection unit when it is determined that the exhaust gas is at one of a stoichiometric and rich air/fuel ratio, and that permits the application of the estimated sulfur concentration when the temperature detected by the catalytic temperature detection unit is lower than a predetermined temperature.

2. The exhaust gas control apparatus according to claim 1, further comprising an air/fuel ratio control unit that controls the air/fuel ratio of the exhaust gas into one of the stoichiometric state and the rich state.

3. The exhaust gas control apparatus according to claim 2, wherein the exhaust catalyst comprises a NOx catalyst of occlusion and reduction type, a NOx occluded amount estimation unit is provided for estimating an amount of NOx that has been occluded in the NOx catalyst, and the air/fuel ratio control unit controls the air/fuel ratio of the exhaust gas into one of the stoichiometric state and the rich state when the NOx occluded amount estimated by the NOx occluded amount estimation unit is determined to be equal to or larger than a predetermined amount.

4. The exhaust gas control apparatus according to claim 2, wherein the air/fuel ratio control unit executes a rich spike control in which the air/fuel ratio of the exhaust gas is temporarily brought into the rich state at a predetermined cycle, and the air/fuel ratio control unit comprises a rich amount increase unit that executes at least one of a control for holding the air/fuel ratio of the exhaust gas in the rich state for a longer time than a time under the rich spike control, and a control for bringing the air/fuel ratio of the exhaust gas into a richer state than a state under the rich spike control.

5. An exhaust gas control method for an internal combustion engine, in which an exhaust catalyst is disposed in an exhaust passage of the internal combustion engine, the method comprising:

detecting, with a concentration detection unit, a total concentration of a sulfur oxide and a hydrogen sulfide contained in an exhaust gas that passes through the exhaust catalyst;

detecting, with the concentration detection unit, a concentration of the sulfur oxide: and detecting a temperature of the exhaust catalyst, wherein a sulfur concentration of a fuel is estimated based on a detection value of the concentration detection unit when it is determined that the exhaust gas is at one of a stoichiometric and rich air/fuel ratio, and the estimated sulfur concentration is applied when the detected temperature is lower than a predetermined temperature.

6. The exhaust gas control method according to claim 5, wherein the air/fuel ratio of the exhaust gas is controlled into one of the stoichiometric state and the rich state.

7. The exhaust gas control method according to claim 6, wherein a rich spike control in which the air/fuel ratio of the exhaust gas is temporarily brought into the rich state is executed at a predetermined cycle, and at least one of a control for holding the air/fuel ratio of the exhaust gas in the rich state for a longer time than a time under the rich spike control, and a control for bringing the air/fuel ratio of the exhaust gas into a richer state than a state under the rich spike control is executed.

8. The exhaust gas control method according to claim 6, wherein an amount of NOx that has been occluded in a NOx catalyst provided as the exhaust catalyst is estimated, and the air/fuel ratio of the exhaust gas is controlled into one of the stoichiometric state and the rich state when the estimated occluded amount of the NOx is determined to be equal to or larger than a predetermined amount.

* * * * *